US007758078B2

(12) United States Patent
Keller

(10) Patent No.: US 7,758,078 B2
(45) Date of Patent: Jul. 20, 2010

(54) SECURITY ELEMENT AND METHOD FOR PRODUCING THE SAME

(75) Inventor: Mario Keller, Bad Endorf (DE)

(73) Assignee: Giesecke & Devrient GmbH, Munich (DE)

( * ) Notice: Subject to any disclaimer, the term of this patent is extended or adjusted under 35 U.S.C. 154(b) by 612 days.

(21) Appl. No.: 10/531,258

(22) PCT Filed: Nov. 25, 2003

(86) PCT No.: PCT/EP03/13247

§ 371 (c)(1),
(2), (4) Date: Sep. 22, 2005

(87) PCT Pub. No.: WO2004/049353

PCT Pub. Date: Jun. 10, 2004

(65) Prior Publication Data

US 2006/0097511 A1 May 11, 2006

(30) Foreign Application Priority Data

Nov. 28, 2002 (DE) ..... 102 55 639

(51) Int. Cl.
*B44C 1/26* (2006.01)

(52) U.S. Cl. ..... 283/72; 428/67; 283/74

(58) Field of Classification Search ..... 428/67, 428/915, 916; 283/72, 74, 93, 94, 101, 105, 283/113, 85, 87, 89; 162/134, 140, 117, 162/135

See application file for complete search history.

(56) References Cited

U.S. PATENT DOCUMENTS 447,336 A * 3/1891 Macdonough ..... 162/140
4,892,336 A * 1/1990 Kaule et al. ..... 283/91
5,354,099 A * 10/1994 Kaule et al. ..... 283/85
5,388,862 A * 2/1995 Edwards ..... 283/82
5,443,889 A * 8/1995 Ruppel et al. ..... 428/172
5,516,153 A * 5/1996 Kaule ..... 283/85
5,573,639 A * 11/1996 Schmitz et al. ..... 162/140
5,599,047 A * 2/1997 Kaule et al. ..... 283/85
5,688,587 A * 11/1997 Burchard et al. ..... 442/330
5,697,649 A * 12/1997 Dames et al. ..... 283/83
5,759,420 A * 6/1998 Minnetian et al. ..... 216/24
5,803,503 A * 9/1998 Kaule et al. ..... 283/85
5,876,068 A 3/1999 Schneider et al.
5,944,927 A * 8/1999 Seifert ..... 156/153
6,030,691 A 2/2000 Burchard et al.
6,318,758 B1 * 11/2001 Stenzel et al. ..... 283/91
6,343,745 B1 * 2/2002 Bohm et al. ..... 235/493
6,344,261 B1 * 2/2002 Kaule et al. ..... 428/195.1
6,352,804 B1 * 3/2002 Sakamoto et al. ..... 430/7

(Continued)

FOREIGN PATENT DOCUMENTS

| | | |
|---|---|---|
| DE | 3610379 | 10/1987 |
| EP | 0 330 733 | 9/1989 |
| WO | WO 99/04983 | 2/1999 |
| WO | WO 01/83237 | 11/2001 |

*Primary Examiner*—Dana Ross
*Assistant Examiner*—Pradeep C Battula
(74) *Attorney, Agent, or Firm*—Bacon & Thomas, PLLC

(57) ABSTRACT

The invention relates to a security element (12, 18) with a carrier film (20) and a cover layer (22; 42; 50) applied to the carrier film (20). The cover layer has gaps (24; 30, 32, 34; 44) in the form of characters or patterns forming visually and/or machine readable first information. Additionally, a printed image (26; 36, 38, 40; 46, 48; 52) forming visually and/or machine readable second information is disposed in the gaps (24; 30, 32, 34; 44) in register, the first and second information being different.

21 Claims, 3 Drawing Sheets

U.S. PATENT DOCUMENTS 6,428,051 B1 * 8/2002 Herrmann et al. ..... 283/107
6,474,695 B1 11/2002 Schneider et al.
6,491,324 B1 * 12/2002 Schmitz et al. ..... 283/82
7,040,663 B1 * 5/2006 Plaschka et al. ..... 283/72
2003/0087070 A1 5/2003 Souparis
2005/0012326 A1 * 1/2005 Keller et al. ..... 283/94
2005/0104364 A1 * 5/2005 Keller et al. ..... 283/72
2005/0151368 A1 * 7/2005 Heim ..... 283/72

* cited by examiner

SECURITY ELEMENT AND METHOD FOR PRODUCING THE SAME

BACKGROUND

This invention relates to a security element with a carrier film and a cover layer applied to the carrier film, said cover layer having gaps in the form of characters or patterns forming visually and/or machine readable first information. The invention relates further to a security paper and an object of value having such a security element, and to a method for producing such a security element.

SUMMARY

Bank notes and other papers equivalent to money, such as shares, checks, traveler's checks, check or credit cards, as well as other papers in danger of being forged, such as passports and other identity cards, are often protected from forgery by incorporation or application of so-called security threads. All papers of this kind will be hereinafter referred to as security papers. The security threads used typically consist of a plastic film that is metallically coated, printed, dyed or also provided with pigment-like substances.

If the metallically coated threads are disposed partly or wholly inside the paper, these areas are virtually invisible in reflected light but appear as striking black strips in transmitted light. Such an effect cannot be imitated by a print on the paper and therefore contributes particularly to forgery-proofness.

Security films are also known that contain diffraction patterns such as holograms, kinegrams or pixelgrams. The protection from forgery of such elements is based on the variable color effect that they convey to the viewer in dependence on the viewing direction. Such security films are often applied in the form of strips or labels to objects of value such as documents of value, or for product protection to any other objects to be protected.

To further increase security and as protection from forgery, security threads or security films are often provided with so-called negative writing. Such negative writing is formed by metal-free areas in an otherwise continuous metallic coating of the carrier material of the security element. Against the light the element itself appears dark due to the opaque metallic coating. The metal-free areas stand out from this dark background in easily recognizably fashion as light areas. The special security effect of negative writing lies in particular in the elaborate and complex production process, which requires a great deal of technical experience, large equipment expense, special printing inks and a great number of working steps.

Methods for producing gaps in the form of characters or patterns are stated for example in the print EP 0 330 733 A1. Said print describes in particular a production method by which a thermoplastic synthetic ink is printed on the metal-coated side of a film, said ink softening when heated and bonding intimately with the metal layer. When a thus pretreated film is laminated against a second untreated film under heat and pressure and the two films separated after cooling, the areas of the metallic coatings corresponding to the characters or patterns are removed from the first film along with the ink.

The print DE 36 10 379 A1 discloses a method for producing packaging material by which a printed image is first printed on the films as it is later to appear as a negative image in the metal coating. The printed image is applied by gravure printing or flexography. Inks or lacquers are used that have only little adhesion to the following metal coating. Then the metal coating is applied to the printed film in a further method step. The metal coating is finally removed by the action of an air or liquid jet or by a mechanical scraping device to expose the gaps in the form of the printed image.

All described methods have a working step in which the information that is later to be present in the form of gaps is printed either with poorly adhering or caustic inks. Since this printing step requires the production of separate printing forms such as a special gravure printing cylinder, this is very labor- and cost-intensive. Negative characters can therefore be incorporated economically into the security elements only when an accordingly high number of elements is produced. For small numbers or for series that are to be provided with a plurality of different designs of negative characters, the production costs are too high in known methods.

It is also known to provide the carrier film of a security thread with a printed gray cover layer having gaps for forming e.g. negative writing. The gray color of the cover layer comes from metallic pigments of the printing ink that are normally referred to by the name "SuperSilver." Since the security thread is printed in a printing machine with the aid of register marks, it is easily possible to dispose a colored imprint in the gaps in register. However, the gray color of the cover layer is frequently undesirable, in particular when the security thread is recognizable on the surface of the document of value in which it is incorporated, as is the case for example with a windowed security thread in a bank note.

The invention is therefore based on the problem of specifying a security element and method for producing it that avoids the disadvantages of the prior art. In particular, an optically appealing design of the security element should be combined with low production costs even for small numbers of elements or series with varying information content.

According to the invention, a security element of the abovementioned kind has disposed in register in the gaps of the cover layer a printed image forming visually and/or machine readable second information, the first and second information being different. The invention is based on the finding that the printed image in register in the gaps can be created using digital printing methods, which cannot be used in direct security printing due to the danger of imitation in view of their wide spread and easy handling.

In the inventive security element the security effect is already obtained by the elaborate production process of the cover layer with gaps, as described in detail above. It is therefore unnecessary to use a maximally forgery-proof method for printing in the gaps as well. Instead, a printed image whose information content differs from the information content formed by the gaps themselves can be incorporated into the gaps economically even in small series using digital printing. For example, bank notes of different denomination can be provided in the gaps with a particular printed image representing the denomination while the gaps have the same geometrical shape. It is also possible to give each individual security element an individual design, e.g. by different coloration, color flows or a characteristic number.

The cover layer can be of opaque, screened or at least semitransparent design. Combinations of said designs are also possible, the cover layer e.g. being opaque in first areas and screened in other areas. The screen can have e.g. the form of a dot screen, a line screen or a screen of repeating similar screen elements of any geometrical shape.

According to a preferred embodiment, the cover layer comprises a metal coating. In particular, the metal coating can be formed of aluminum, gold, copper, iron, nickel or an alloy containing one or more of said metals. The metal layer is preferably applied to the carrier film by vapor deposition or by electron-beam vaporization. Metallic cover layers are very attractive visually due to their lustrous effect and can therefore also be disposed on the surface of a document of value.

The metal coating can additionally be combined with a plastic layer with a surface relief in the form of a diffraction structure embossed therein. This makes it possible to produce an optically variable effect, in particular a color effect dependent on viewing angle.

Alternatively, the cover layer can also contain a dielectric layer structure that is opaque or semitransparent. Such layer structures also produce different color effects for the viewer in reflected light upon a change of viewing angle. Such cover layers are likewise optically appealing and can therefore also be disposed on the surface of a document of value.

The gaps are produced either by subsequently removing the metal layer by etching methods or by layer ablation, for example using a laser. However, it is preferable to use the so-called "washing method," by which ink is printed on a carrier film in the form of the later gaps before application of the cover layer. After all-over application of the cover layer, said ink is dissolved by a corresponding solvent, preferably water, so that both the ink and the cover layer are removed in this area.

The printed image incorporated in the gaps can be finely structured and/or of high resolution, such as a pattern of guilloche lines. The printed image can contain an ink containing luminescent pigments, magnetic pigments, liquid crystal pigments and/or interference layer pigments. Inks with liquid crystal pigments or interference layer pigments permit optically variable effects to be produced in the printed image. The printed image can also be multicolored or formed of a plurality of inks with different pigment content.

In particular it can be provided according to the invention that the printed image forms letters, numbers or any desired geometrical figures that represent the visually and/or machine readable second information. First visually and/or machine readable information is already formed by the gaps in the cover layer. The gaps can also form letters, numbers or geometrical figures, but the first and second information is different according to the invention. For example, the gaps can form geometrical figures in which a characteristic number, e.g. the denomination of a bank note, a portrait or a symbol such as a national flag, is printed.

The printed image is advantageously printed into the gaps by a digital printing method. Digital printing methods refer here to those printing methods by which information is applied to the medium to be printed directly from a computer without creation of a master.

The digital printing methods preferably used in the invention include virtual digital printing methods such as ink jet, thermal sublimation or thermal transfer, temporary digital printing methods such as electrophotographic methods, ionography or magnetography, in particular toner-based printing methods such as laser printing, or also liquid-ink methods such as Indigo.

Ink jet printing refers here to various monochrome or color non-impact printing technologies working with liquid or melted inks based on dyes or pigments. The ink drops can either be shot onto the printing substrate discontinuously on demand (drop-on-demand), or a continuous ink jet of drops with a defined diameter is produced and the drops not required for image formation are charged electrically when passing through a charging station and deflected into a gutter under the influence of an electric field so that only the uncharged drops reach the printing substrate for image formation (continuous ink jet).

Electrophotographic printing methods, in particular laser copying methods, are various technologies in which a drum coated with photoreceptor material is rendered electroconductive by irradiation using lasers or light-emitting diodes. Toner collects at the irradiated places and is transferred to the printing substrate and fixed under heat.

According to the inventive method for producing a generic security element, the cover layer with the gaps is preferably first applied to the carrier film, and then the printed image produced in the gaps of the cover layer in register by digital printing. It is thus not necessary to produce the printed image in a separate printed layer before applying the cover layer. Alternatively, it is also possible to first produce the printed image and then apply the cover layer.

In preferred embodiments, the security element forms a security thread or a tear thread, or a transfer element or a label for protecting an object of value.

The invention also includes a security paper provided with a security element of the described kind in the form of a thread or band. The security element can be embedded into the security paper as a windowed security thread or disposed completely on the surface of the security paper. It is of course also possible to embed the security thread completely into the paper. Alternatively, the security paper can be provided with a security element of the described kind in the form of a transfer element glued to the security paper.

It may be expedient for the printed image disposed in the gaps to repeat the motif of another printed image of the security paper, such as a national flag, a denomination, a portrait or an architectural motif. Such a design results in a graphically appealing design of the security paper and makes forgeries easy to recognize.

The invention also includes an object of value provided with a security element of the described kind, in particular in the form of a transfer element or label mounted, preferably glued, on the object of value. The individual layers of the security element can be produced directly on the object of value or prepared on a separate carrier. The security element can be formed as a self-supporting label, or it is produced on a transfer material from which it is transferred to the object of value in the desired outline form. A hot-melt adhesive is preferably used for fixation to the object of value.

The object of value can be a document of value, product package or any other object to be protected. For example, the security elements can be used as laminated films in passports or other identity cards. Also, the documents of value provided with the security element can be used in turn to protect other objects.

Further embodiments and advantages of the invention will be explained in the following with reference to the figures. For better clarity the figures are not true to scale or proportion.

DETAILED DESCRIPTION OF VARIOUS EMBODIMENTS

Figure 1:
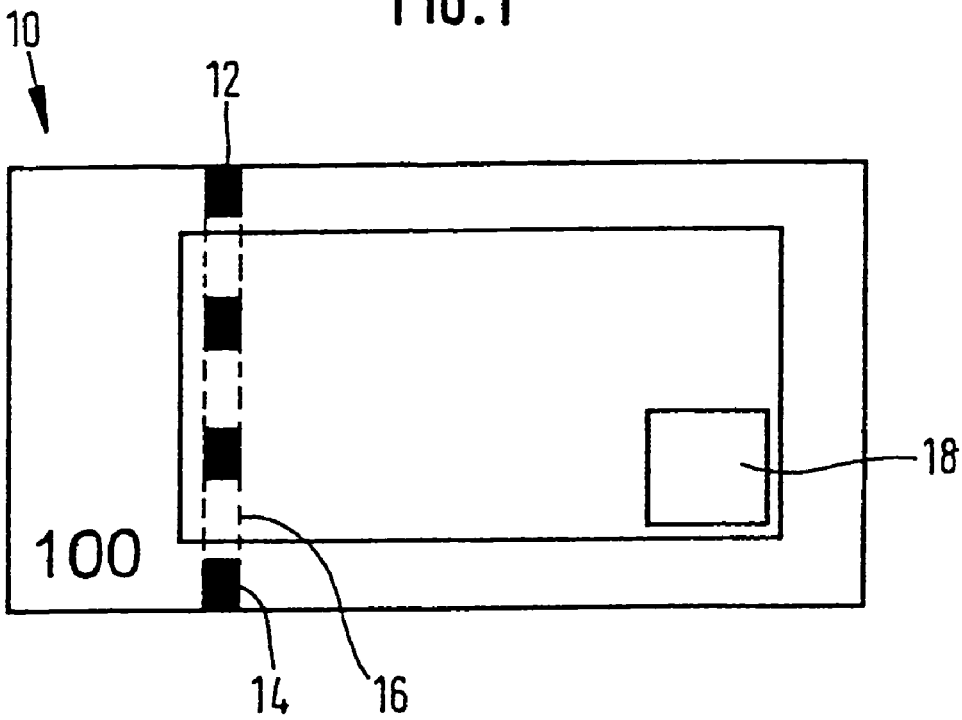
FIG. 1 shows a schematic view of a bank note with an embedded security thread and glued transfer element, each according to an embodiment of the invention.

FIG. 1 shows a schematic view of bank note 10 provided with embedded windowed security thread 12 and glued transfer element with diffraction structures 18. Windowed security thread 12 passes with its metallic lustrous coating to the surface of bank note 10 in certain areas 14 while being embedded inside bank note 10 in areas 16 therebetween. Transfer element 18 is glued to the surface of bank note 10 with hot-melt adhesive. Both windowed security thread 12 and transfer element 18 have a cover layer with gaps not shown in FIG. 1 in which a printed image is incorporated by digital printing.

In the following, the structure and design of an inventive security element will be explained in more detail by the example of security thread 12. Transfer element 18 or other embodiments of security elements can be designed analogously. It must only be ensured that with transfer elements the layer sequence is present on a carrier film in reverse order so that the security element applied to the object of value has the structure shown in the figures.

Figure 2:
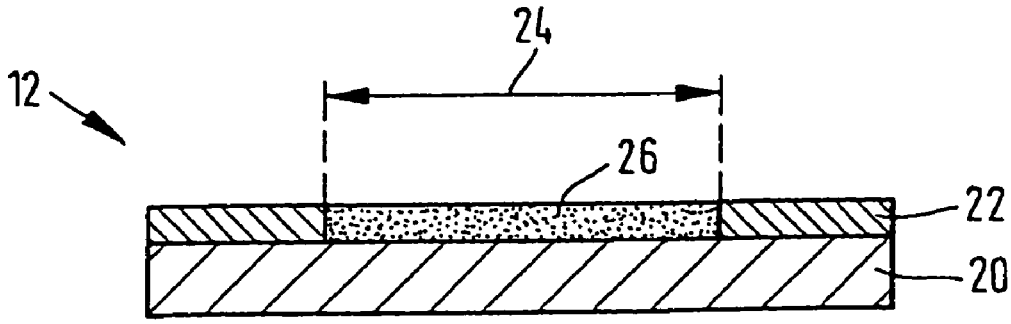
FIG. 2 shows the layer structure of a security thread according to an embodiment of the invention.

FIG. 2 shows schematically the layer structure of security thread 12 in cross section. According to FIG. 2, security thread 12 comprises transparent plastic layer 20 to which metallic coating 22, in this embodiment an aluminum layer, is applied. Metal layer 22 has gaps 24 in the form of letters, numbers or geometrical shapes which can be provided both in areas 14 located on the surface of bank note 10 and in areas 16 located inside the paper. For inside areas 16 the information in the form of gaps 24 is visible or readable only in transmitted light. For areas 14 of security thread 12 located on the surface, the represented information is also recognizable in reflected light. Gaps 24 of metal layer 22 have printed image 26 printed thereinto by digital printing.

For producing the layer structure of FIG. 2, metal layer 22 with gaps 24 is first applied to plastic film 20, and printed image 26 then produced in a following step in gaps 24 of metal layer 22 in register by a digital printing method, in this embodiment an ink jet method.

The shape of gaps 24 forms first information which can be readable visually for a viewer or by machine for a reading device. Printed image 26 then constitutes second information within gaps 24 that is different from the first information and can likewise be readable visually or by machine. It may be provided that the information of printed image 26 becomes visible only through special measures, for example heating, cooling or irradiation with ultraviolet or infrared light. Thus, printed image 26 can be for example of thermochromic or luminescent design.

Alternatively, the layer structure can be produced by first creating printed image 26 and then applying the metal layer with the gaps. It is also conceivable to combine a printed image produced by digital printing with a cover layer produced by printing SuperSilver.

Figure 2A:
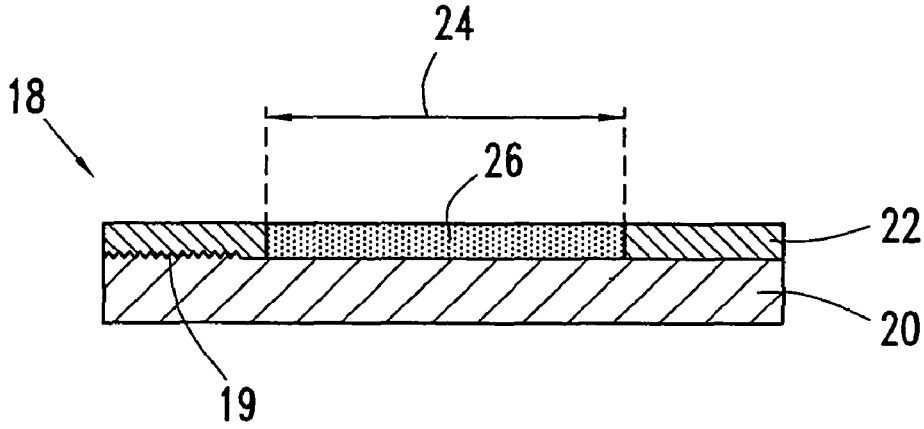
FIGS. 2A and 2B depict variations of a transfer element having diffraction structures embossed thereon.
Figure 2B:
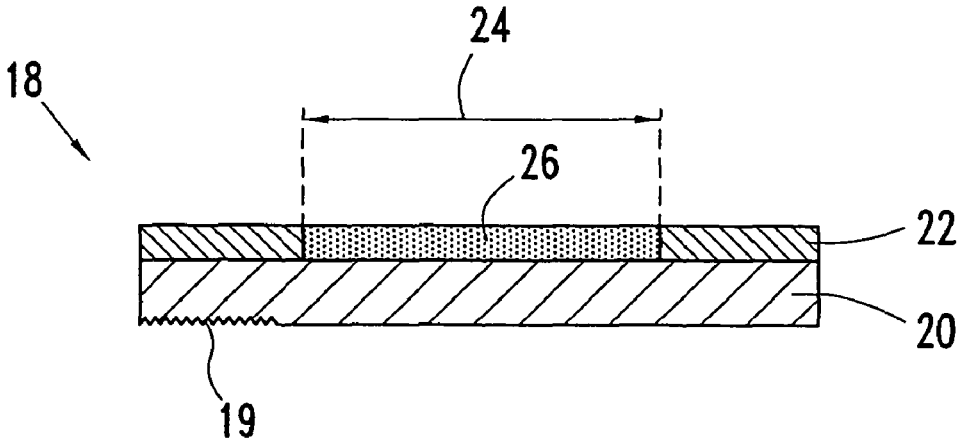

FIGS. 2A and 2B depict variations of a transfer element 18 containing a plastic layer 20 with a surface relief in the form of a diffraction structure 19 embossed thereon.

Figure 3:
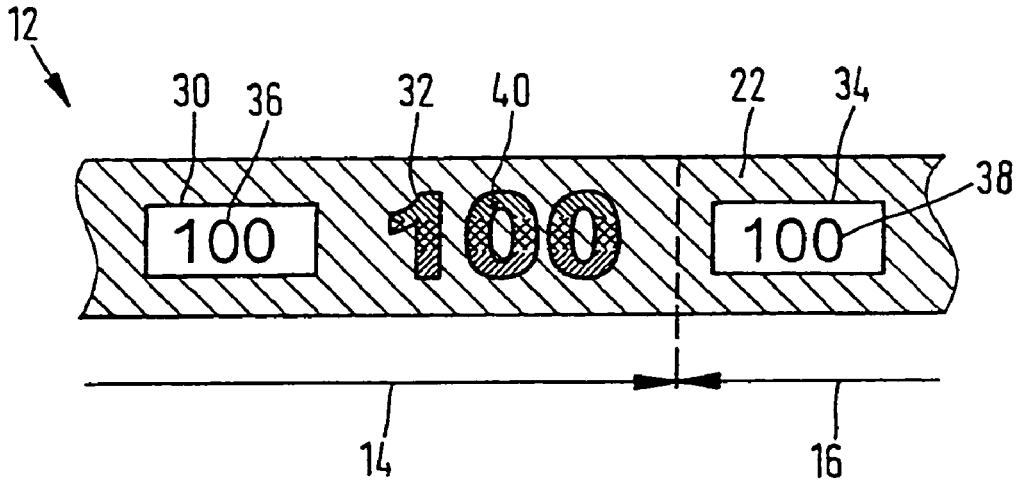
FIGS. 3 to 5 show different designs of a security thread according to preferred embodiments of the invention.
Figure 4:
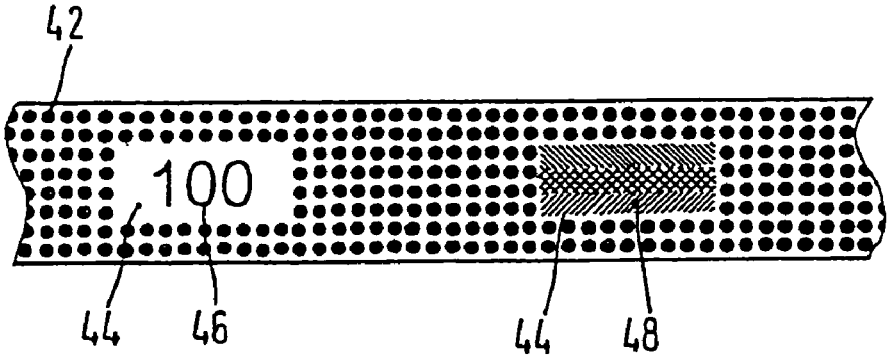
Figure 5:
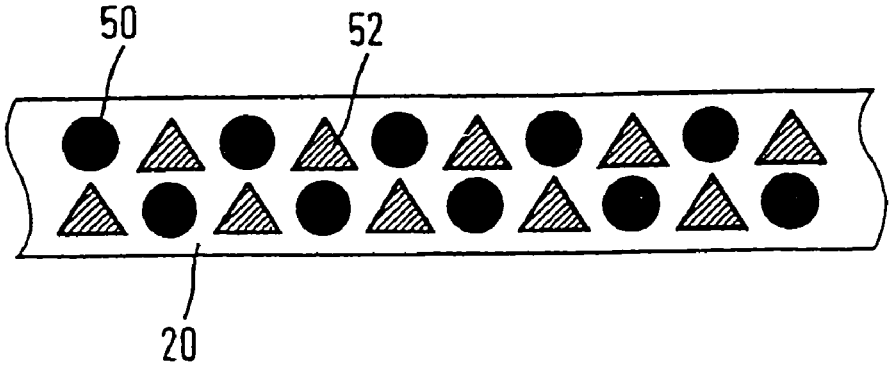

FIGS. 3 to 5 show some advantageous variants of the design of gaps 24 and printed image 26 for security thread 12 in a schematic view.

In the embodiment of FIG. 3, security thread 12 has opaque metal coating 22 of aluminum, as in FIG. 2. Metal layer 22 is provided with gaps 30, 34 in the form of rectangular windows and with gaps 32 in the form of a characteristic number stating in this embodiment the denomination of the bank note for which thread 12 is intended.

The denomination of the bank note is additionally printed into rectangular windows 30, 34 as printed image 36, 38 by digital printing. Printed images 36 and 38 can be multicolored in each case and/or executed differently in different rectangular windows 30, 34. In the embodiment of FIG. 3 showing windowed security thread 12, printed image 36 is executed for example in two colors with opaque ink while print 38 is done with luminescent ink. When excited by UV light, said printed image lights up and thereby contributes to high forgery-proofness of bank note 10.

Number-shaped gaps 32 representing the denomination of bank note 10 in their outline have a representation of the issuing country's national flag 40 printed thereinto by digital printing. The print is done according to the coloration of the particular flag. Here, too, inks with pigments producing special optical effects can be used.

A further embodiment of an inventive security element is shown in FIG. 4. In this embodiment, the security thread is executed with a cover layer in the form of regular metal screen 42 having rectangular gaps 44. Gaps 44 have for example the denomination of bank note 46 or national flag 48 printed thereinto by digital printing, as described above in connection with the embodiment of FIG. 3.

In a further variant, the metal layer is executed not areally but as a sequence of smaller geometrical units. A possible embodiment is shown in FIG. 5. The metal layer is applied to carrier film 20 in the form of spaced circular elements 50. In the spaces or gaps between the circular elements there is a printed image likewise consisting of geometrical shapes. In this embodiment the printed image is formed by spaced colored triangles 52 each printed in the center between two adjacent metal elements 50 by digital printing. It is obviously also possible to represent, instead of triangles 52, other geometrical shapes or the denomination of the bank note and/or the national flag, as in FIGS. 3 and 4.

The invention claimed is:

1. A security paper, comprising:

a security element at least partially embedded within the security paper, the security element including a cover layer having gaps in the form of characters or patterns forming visually and/or machine readable first information, wherein a printed image in the form of letters, numbers or geometrical figures forming visually and/or machine readable second information is printed within the gaps in register by a digital printing method, and further wherein the content of the second information within the gaps is different from the content of the first information of the respective gap within which the second information is disposed, and further wherein an information conveyed by an overall contour of the first information is different from an information conveyed by an overall contour of the second information and the form of the letters, numbers or geometrical figures forming the second information is different from the form of the characters or patterns forming the first information.

2. The security paper according to claim 1, wherein the cover layer is opaque at least in partial areas.

3. The security paper according to claim 1, wherein the cover layer is screened at least in partial areas, said screen being selected from the group consisting of a dot screen, a line screen and a screen of repeating similar screen elements.

4. The security paper according to claim 1, wherein the cover layer is semitransparent at least in partial areas.

5. The security paper according to claim 1, wherein the cover layer comprises a metal coating, the metal coating being selected from the group consisting of aluminum, gold, copper, iron, nickel and an alloy containing one or more of said metals.

6. The security paper according to claim 1, wherein the cover layer contains a dielectric layer structure that produces different color effects in reflected light upon a change of viewing angle.

7. The security paper according to claim 6, wherein the dielectric layer structure is opaque or semitransparent.

8. The security paper according to claim 1, wherein the printed image is finely structured and/or of high resolution.

9. The security paper according to claim 1, wherein the printed image contains an ink containing pigments selected from the group consisting of luminescent pigments, magnetic pigments, liquid crystal pigments and interference layer pigments.

10. The security paper according to claim 1, wherein the printed image is multicolored or formed of inks with different pigment content.

11. The security paper according to claim 1, wherein the gaps form letters, numbers or geometrical figures.

12. The security paper according to claim 1, wherein the security element forms a security thread or a tear thread.

13. The security paper according to claim 1, wherein the security element forms a transfer element or a label for protecting an object of value such as a document of value.

14. The security paper according to claim 1, wherein the security element is present in the form of a thread or band.

15. The security paper according to claim 14, wherein the security element is embedded into the security paper as a windowed security thread.

16. The security paper according to claim 1, wherein the printed image disposed in the gaps repeats the motif of another printed image of the security paper, such as, for example, a national flag, a denomination, a portrait or an architectural motif.

17. The security paper according to claim 1, wherein the security element is in the form of a transfer element or label.

18. The security paper according to claim 1, wherein the security element contains a plastic layer with a surface relief in the form of a diffraction structure embossed thereinto.

19. A method for producing a security paper according to claim 1, wherein the security paper includes a security element at least partially embedded within the security paper, comprising:

first applying the cover layer with the gaps in the form of characters or patterns to a carrier film and then producing the printed image in the form of letters, numbers or geometrical figures within the gaps in register by digital printing, such that an information conveyed by an overall contour of the first information is different from an information conveyed by an overall contour of the second information and the form of the letters, numbers or geometrical figures forming the second information is different from the form of the characters or patterns forming the first information.

20. The method according to claim 19, wherein the cover layer comprises a metal layer, and the metal layer is applied by vapor deposition or by electron-beam vaporization.

21. The method according to claim 19, wherein the printed image is produced in the gaps by a virtual printing method selected from the group consisting of digital printing such as ink jet, thermal sublimation or thermal transfer, a temporary digital printing method such as an electrophotographic method, ionography or magnetography, in particular by a toner-based printing method such as laser printing, and a liquid-ink method such as Indigo.

* * * * *